United States Patent [19]

Zylstra

[11] Patent Number: 4,746,891

[45] Date of Patent: May 24, 1988

[54] HIGH SATURATION THREE COIL CURRENT TRANSFORMER

[75] Inventor: Henry J. Zylstra, Alburnette, Iowa

[73] Assignee: Square D Company, Palatine, Ill.

[21] Appl. No.: 725,071

[22] Filed: Apr. 19, 1985

[51] Int. Cl.[4] ..... H01F 27/30; H01F 40/06

[52] U.S. Cl. ..... 336/171; 336/175; 336/181; 336/184; 361/87; 361/93

[58] Field of Search ..... 336/170, 176, 180, 182, 336/184, 212, 174, 173, 175, 181, 171, 68; 29/605-607; 323/357, 358; 324/424; 340/638; 361/87, 93

[56] References Cited

U.S. PATENT DOCUMENTS

| | | | |
|---|---|---|---|
| 1,748,993 | 3/1930 | Purdy | 336/180 X |
| 1,866,751 | 7/1932 | Butow | 336/174 X |
| 2,001,897 | 5/1935 | West et al. | 336/175 X |
| 2,924,796 | 2/1960 | Stauber et al. | 336/174 X |
| 3,175,175 | 3/1965 | Hauck | 336/175 |
| 3,201,731 | 8/1965 | Baenziger et al. | 336/212 |
| 3,268,843 | 8/1966 | Popp | 336/175 X |
| 3,546,565 | 12/1970 | Downing, Jr. et al. | 336/175 X |
| 3,996,543 | 12/1976 | Conner et al. | 336/174 X |
| 4,309,655 | 1/1982 | Lienhard et al. | 336/212 X |
| 4,513,274 | 4/1985 | Halder | 336/180 X |

FOREIGN PATENT DOCUMENTS

| | | | |
|---|---|---|---|
| 439901 | 12/1935 | United Kingdom | 336/68 |

OTHER PUBLICATIONS

Normet, Current Indicator is Overload-Proof, 1/6/77, Electronics vol. 50, No. 1, p. 114, Pub. McGraw-Hill Inc.

*Primary Examiner*—Thomas J. Kozma
*Attorney, Agent, or Firm*—Larry I. Golden; Mary R. Jankousky; Richard T. Guttman

[57] ABSTRACT

A high saturation three coil current transformer for use with electrical apparatus having a U-shaped conductor portion. The current transformer has a ferromagnetic core surrounding one leg of the U-shaped conductor. The core is formed from two U-shaped core portions. A first coil and a second coil are wound on bobbins, with one bobbin being placed around each juncture between the core portions. A third coil is wound about the middle section of one of the U-shaped core portions prior to the core portions being joined. The current transformer is positioned so that the U-shaped conductor surrounds the third coil.

11 Claims, 1 Drawing Sheet

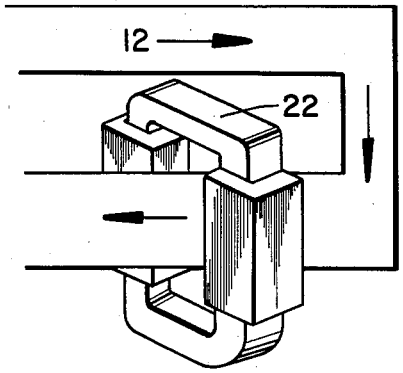
FIG. 1
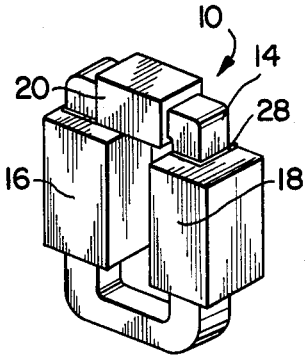
FIG. 2
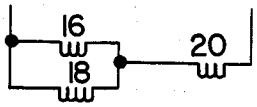
FIG. 3
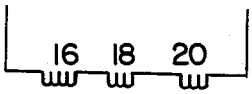
FIG. 4
FIG. 5
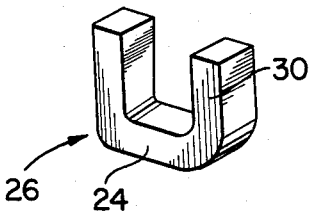

HIGH SATURATION THREE COIL CURRENT TRANSFORMER

FIELD OF THE INVENTION

This invention relates to electric circuit breakers and in particular to current transformers for electric circuit breakers.

Current transformers are used with circuit breakers to monitor the current flowing through the breaker. A current transformer generally has a ferromagnetic core surrounding the main current path of the circuit breaker, with the core being supplied with one or more coils. The main current through the circuit breaker induces a magnetic flux in the core, which in turn generates a current in each coil proportional to the current through the circuit breaker.

The current transformer coils supply current to meters or relays monitoring the circuit breaker current. It is important that the current through the current transformer accurately reflect the circuit breaker current so that the metering devices may appropriately coordinate the opening and closing of various switches and circuit breakers.

Current transformers that normally perform well will exhibit distortion when subjected to a high magnetization force, such as that which occurs when the main current path surrounds the core on a number of sides as shown in FIG. 1. The close proximity of the main current path to the core will cause the core to saturate at a relatively low current level. In designing a compact circuit breaker, it is sometimes necessary to position the main current path close to the current transformer. In these designs there is a need for a current transformer that has a high saturation level.

SUMMARY OF THE INVENTION

The preferred embodiment of the present invention utilizes a generally O-shaped ferromagnetic core having two coils positioned on opposite sides of the core and a third coil surrounding that portion of the core nearest the main conductor through the circuit breaker. The first two coils are electrically connected in parallel, with the parallel combination connected in series with the third coil. The coils connected in parallel generally have the same number of amp turns. The third coil preferably has a greater number of amp turns then either of the parallel coils to oppose the high magnetic forces caused by the proximity of the conductor to the third coil. The O-shaped magnetic core is formed from two U-shaped core portions joined at the legs. The third coil is wound around the middle portion of one of the U-shaped core portions. The parallel coils are wound on bobbins and placed on the legs of the U-shaped core portions before the core portions are joined.

BRIEF DESCRIPTION OF THE DRAWINGS

FIG. 1 shows a current transformer having two coils and a main conductor in close proximity to the current transformer core.

FIG. 2 shows a perspective view of the preferred embodiment of the present invention of a high saturation current transformer.

FIG. 3 shows a schematic diagram of the electrical connection between the current transformer coils of the preferred embodiment.

FIG. 4 shows a schematic diagram of an alternative electrical connection between the current transformer coils.

FIG. 5 shows a perspective view of a C-shaped core portion.

DESCRIPTION OF THE PREFERRED EMBODIMENT

Figure 6:
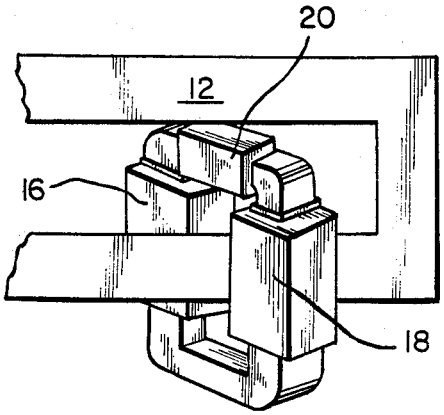
FIG. 6 shows a perspective view of the preferred embodiment of the present invention or a high saturation current transformer and main conductor.

The preferred embodiment of the high saturation current transformer, indicated generally in FIG. 2 by the reference character 10, includes an O-shaped core 14 made of layers of ferromagnetic material, such as silicon steel. The core 14 may be made by various methods known in the art, such as tape winding about a mandrel or layering of laminations. Often a number of coils are positioned around the core 14, as shown in FIG. 1. The main conductor 12 of the circuit breaker is positioned through the center of the core 14, inducing a magnetic flux in the core which in turn induces current in the coils positioned around the core.

A main conductor 12 is positioned close to a number of sides of a core middle portion 22 as shown in FIG. 1. High current through the conductor 12 produces high magnetization forces in the middle portion 22, saturating the core 14 prematurely. When the core saturates, the current transformer no longer accurately reflects the breaker current. The spacing between the conductor 12 and core 14 required to prevent the premature saturation of the core 14 depends on the level of current through the conductor 12. For example, at approximately 15,000 to 20,000 amperes through the conductor 12, the core 14 saturates prematurely at an approximate distance of 3 inches to 4 inches from the conductor 12.

To oppose the saturation in the core 14, a third coil 20 is wound about that middle portion 22 of the core 14 nearest the conductor 12. Current is induced in the three coils 16, 18, and 20 to oppose the saturation of the core 14.

Preferably coil 20 has greater ampere turns than either coil 16 or 18 to oppose the flux induced in middle portion 22 where the magnetic forces are highest. In the preferred embodiment of the subject invention, the Amp-turns per unit length of coil 20 are greater than the Amp-turns per unit length of either coil 16 or coil 18.

The coils 16, 18 and 20 are also preferably electrically connected in such a way as to provide a higher current through coil 20 than through coil 16 or 18. Coil 16 is connected in parallel with coil 18 and the combination is connected in series with coil 20, as shown in FIG. 3, making the current through coil 20 equal to the sum of the currents through coils 16 and 18. In the alternative scheme, as shown in FIG. 4, all three coils 16, 18 and 20 are connected in series to produce the same current through all coils. FIG. 3 shows the preferred arrangement since it requires fewer turns than the arrangement of FIG. 4 to produce a given number of ampere turns in coil 20.

The O-shaped ferromagnetic core 14 is formed from two U-shaped core portions 26 joined at the legs 30. Prior to joining the core portions, the coil 20 is wound directly on the middle portion 24 or bight portion of the core portion 26. Coils 16 and 18 are wound on bobbins 28 which are placed on the legs 30 of the core portion 26 before the core portions 26 are joined. Any suitable method may be used to connect the core portions, such as winding a metal strap around the outside of the core and securing the strap with a fastener.

While the invention has been shown and described with reference to a preferred embodiment it will be understood by those skilled in the art that variations in form, construction and arrangements may be made therein without departing from the spirit and scope of the invention. All such variations are intended to be covered in the appended claims.

I claim:

1. A current transformer and conductor combination, said current transformer producing a current proportional to the current through the conductor, said current transformer and conductor combination comprising:

only one generally U-shaped conductor having a first leg and a second leg, the first leg being approximately parallel to the second leg, the current flow in the first leg being opposite to the current flow in the second leg, a generally O-shaped ferromagnetic core surrounding the first leg of said conductor, said core having a first portion located between the first leg and the second leg of said conductor, a first coil and a second coil, each coil surrounding a portion of said core other than the first portion, said first and second coils being electrically connected, and a third coil surrounding the first portion of said core, said third coil being electrically connected in series with said first and second coils.

2. A current transformer and conductor combination as claimed in claim 1 wherein said first coil and said second coil are electrically connected in parallel.

3. A current transformer and conductor combination as claimed in claim 2 wherein said core comprises two generally U-shaped core portions, each core portion having two leg portions and a bight portion connecting the leg portions.

4. A current transformer and conductor combination as claimed in claim 3 wherein said third coil surrounds the bight portion of one of said core portions.

5. A current transformer and conductor combination as claimed in claim 4 wherein said current transformer also comprises two bobbins, said first coil and said second coil each being wound about one of said bobbins, each of said bobbins being positioned around a leg portion of each of said core portions.

6. A current transformer and conductor combination as claimed in claim 1 wherein said third coil is positioned on said core at the location nearest the second leg of said conductor, said third coil creating a magnetic flux that opposes the magnetic flux created by a high level of current flow through the second leg of said conductor.

7. A current transformer and conductor combination as claimed in claim 6 wherein said conductor is U-shaped having a bight connecting the first leg and the second leg, wherein said conductor bight is nearer to the first portion of said core than to any other portion of said core.

8. A current transformer and conductor combination as claimed in claim 2 wherein said third coil has greater ampere turns per unit length than either said first coil or said second coil.

9. A current transformer and conductor combination as claimed in claim 1 wherein none of said first coil, said second coil or said third coil are wound on top of another coil.

10. A current transformer and conductor combination as claimed in claim 5 wherein said first coil and said second coil and their associated bobbins are each positioned around the juncture of two core portion leg portions.

11. A current transformer and conductor combination as claimed in claim 1 wherein said conductor passes through said core only once.

* * * * *